US009376129B2

(12) United States Patent
Hilleary

(10) Patent No.: US 9,376,129 B2
(45) **Date of Patent: *Jun. 28, 2016**

(54) METHODS AND SYSTEMS FOR DETECTION AND NOTIFICATION OF BLOCKED RAIL CROSSINGS

(71) Applicant: THE ISLAND RADAR COMPANY, Olathe, KS (US)

(72) Inventor: Thomas N. Hilleary, Lenexa, KS (US)

(73) Assignee: THE ISLAND RADAR COMPANY, Olathe, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/525,702

(22) Filed: Oct. 28, 2014

(65) Prior Publication Data

US 2015/0066255 A1 Mar. 5, 2015

Related U.S. Application Data

(63) Continuation of application No. 13/353,355, filed on Jan. 19, 2012, now Pat. No. 8,909,396.

(60) Provisional application No. 61/436,006, filed on Jan. 25, 2011.

(51) Int. Cl.

| | |
|---|---|
| ***G01S 15/93*** | (2006.01) |
| ***B61L 1/00*** | (2006.01) |
| ***B61L 29/00*** | (2006.01) |
| ***G08G 7/02*** | (2006.01) |
| ***B61L 29/30*** | (2006.01) |
| ***B61L 27/00*** | (2006.01) |

(52) U.S. Cl.
CPC *B61L 29/30* (2013.01); *B61L 27/00* (2013.01)

(58) Field of Classification Search
CPC ..... B61L 27/0027; B61L 27/0077; B61L 27/0038; B61L 27/0005; B61L 23/34; B61L 27/04; B61L 27/00
See application file for complete search history.

(56) References Cited

U.S. PATENT DOCUMENTS

| | | | | |
|---|---|---|---|---|
| 6,179,252 | B1 * | 1/2001 | Roop | B61L 29/18 246/122 R |
| 6,641,091 | B1 | 11/2003 | Hilleary | |
| 8,693,725 | B2 * | 4/2014 | Bobbitt | B61L 17/00 382/103 |
| 2002/0185571 | A1 * | 12/2002 | Bryant | B61L 29/30 246/125 |
| 2004/0249571 | A1 * | 12/2004 | Blesener | B61L 29/28 701/301 |
| 2006/0231685 | A1 * | 10/2006 | Mace | B61L 23/02 246/169 R |
| 2008/0169939 | A1 | 7/2008 | Dickens et al. | |
| 2009/0055043 | A1 * | 2/2009 | Mian | B61L 27/0094 701/31.4 |
| 2013/0018534 | A1 | 1/2013 | Hilleary | |

* cited by examiner

*Primary Examiner* — Jerrah Edwards
*Assistant Examiner* — Demetra Smith-Stewart
(74) *Attorney, Agent, or Firm* — Armstrong Teasdale LLP

(57) ABSTRACT

A blocked rail crossing detection and notification system is described. The system includes a processing device, a communications interface communicatively coupled to the processing device and operable for facilitating communications between the processing device and at least one external device, and at least one vehicle detection mechanism placed proximate to a rail grade crossing. The at least one vehicle detection mechanism is communicatively coupled to the processing device and operable to provide signals to the processing device indicative of the presence or non-presence of a vehicle within a defined area surrounding an intersection of a roadway and one or more railroad tracks. The processing device is further programmed to communicate the presence or non-presence of a vehicle along with supporting correlative visual data within the defined area to the at least one external device via the communications interface.

21 Claims, 4 Drawing Sheets

METHODS AND SYSTEMS FOR DETECTION AND NOTIFICATION OF BLOCKED RAIL CROSSINGS

CROSS REFERENCE TO RELATED APPLICATIONS

This application is a continuation application of U.S. patent application Ser. No. 13/353,355 filed Jan. 19, 2012 which claims the benefit of U.S. Provisional Patent Application Ser. No. 61/436,006 filed Jan. 25, 2011, the disclosures of which are hereby incorporated by reference in their entirety.

BACKGROUND

The field of the disclosure relates generally to railroad grade crossings, and more specifically, to methods and systems for detection and notification of blocked rail crossings.

Train traffic in North America typically intersects with public streets and highways at railroad grade crossings. At such crossings, active and/or passive warning systems provide a notification to automotive traffic regarding the impending arrival of a train. The particular notifications provided are somewhat dependent on the street or highway intersecting the rail line. For example, where average train speeds or automotive traffic volume warrants, active warning systems are deployed which may include one or more of flashing lights, bells, and barrier gates. As high speed rail infrastructure is expanded to promote high-speed intercity passenger service, more attention is being paid to the performance of these warning systems.

While the active warning systems are effective, risks persist. One such risk is that associated with the instance of vehicles that are found within the crossing island, which is the area between barrier gates where the rails are located. Such vehicles may be accidently or deliberately placed in such crossing islands. For example, a vehicle may become disabled while within or near the crossing island. Instances have occurred where automobile drivers have driven around the barrier gates only to find themselves trapped within the crossing island. Instances have also occurred wherein motorists have also mistakenly driven their vehicles outside the crossing island and the Minimum Track Clearance Distance (MTCD) area or zone and onto the railroad tracks, with the vehicles becoming temporarily stuck on the tracks in the path of a potential approaching train. As presently defined in defined in the Manual on Uniform Traffic Control Devices (MUTCD), the minimum track clearance distance is the length along a highway at one or more railroad tracks, measured either from the railroad stop line, warning device or 3.7 m (12 ft) perpendicular to the track centerline to 1.8 m (6 ft) beyond the track(s) measured perpendicular to the far rail, along the centerline or edge line of the highway, as appropriate, to obtain the longer distance.

High mass freight trains, at speeds of 55 miles per hour and greater take thousands of meters to halt, a situation that becomes more perilous with a current emphasis on development of high-speed rail traffic (80-110 MPH (grade separation is required above 110 MPH)). At such speeds, locomotive operators and engineers have insufficient time to halt the train if such an obstruction is visually identified at or near an upcoming crossing.

Currently, railroad companies seek to provide advance warning of track obstruction situations by posting a toll free telephone number on the equipment bungalow near the crossing islands, implicitly encouraging the general public to place a telephone call if a dangerous situation has developed at or near a crossing island. Should a member of the public make the call, the railroad operator will forward the information to locomotive engineers in the vicinity. It is apparent, however, that a more reliable, deterministic means of identifying these risks and communicating actionable information to railroad organizations would be an improvement over current reporting mechanisms.

BRIEF DESCRIPTION

In one aspect, a blocked rail crossing detection and notification system is provided. The system includes a processing device, a communications interface communicatively coupled to the processing device and operable for facilitating communications between the processing device and at least one external device, and at least one vehicle detection mechanism placed proximate to a rail grade crossing. The at least one vehicle detection mechanism is communicatively coupled to the processing device and operable to provide signals to the processing device indicative of the presence or non-presence of a vehicle within a defined area surrounding an intersection of a roadway and one or more railroad tracks. The processing device is further programmed to communicate the presence or non-presence of a vehicle within the defined area, along with supporting correlative visual data, to the at least one external device via the communications interface.

The features, functions, and advantages that have been discussed can be achieved independently in various embodiments or may be combined in yet other embodiments further details of which can be seen with reference to the following description and drawings.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION

The following discussion of exemplary and advantageous embodiments is presented for purposes of illustration and description of the inventive concepts disclosed, and is not intended to be exhaustive or limited to the particular embodiments in the form disclosed. Many modifications and variations of the concepts disclosed will be apparent to those of ordinary skill in the art. Further, different advantageous embodiments may provide different advantages as compared to other advantageous embodiments. The embodiment or embodiments selected are chosen and described in order to best explain the principles of the embodiments, the practical application of the concepts disclosed, and to enable others of ordinary skill in the art to understand the disclosure for various embodiments with various modifications as are suited to the particular uses contemplated. Method aspects implementing advantageous features will be in part apparent and in part explicitly discussed in the description below.

Exemplary embodiments of systems and methods described herein further identify candidate obstruction situations for railroad crossings and communicate blocked crossing notifications to railroad organizations, permitting a judgment to be made as to a course of action. The notifications are generated based on the sensing of a vehicle within the crossing island by one or more of, radar data, visual image data, and data generated by the sensing of vehicles via buried inductive loops within the island. As further described herein, at least one preferred embodiment incorporates radar, specifically, radar-based vehicle detection and associated technology. As further described, a multiplicity of communication channels and modalities may be utilized to communicate notifications to railroad organizations.

Figure 1:
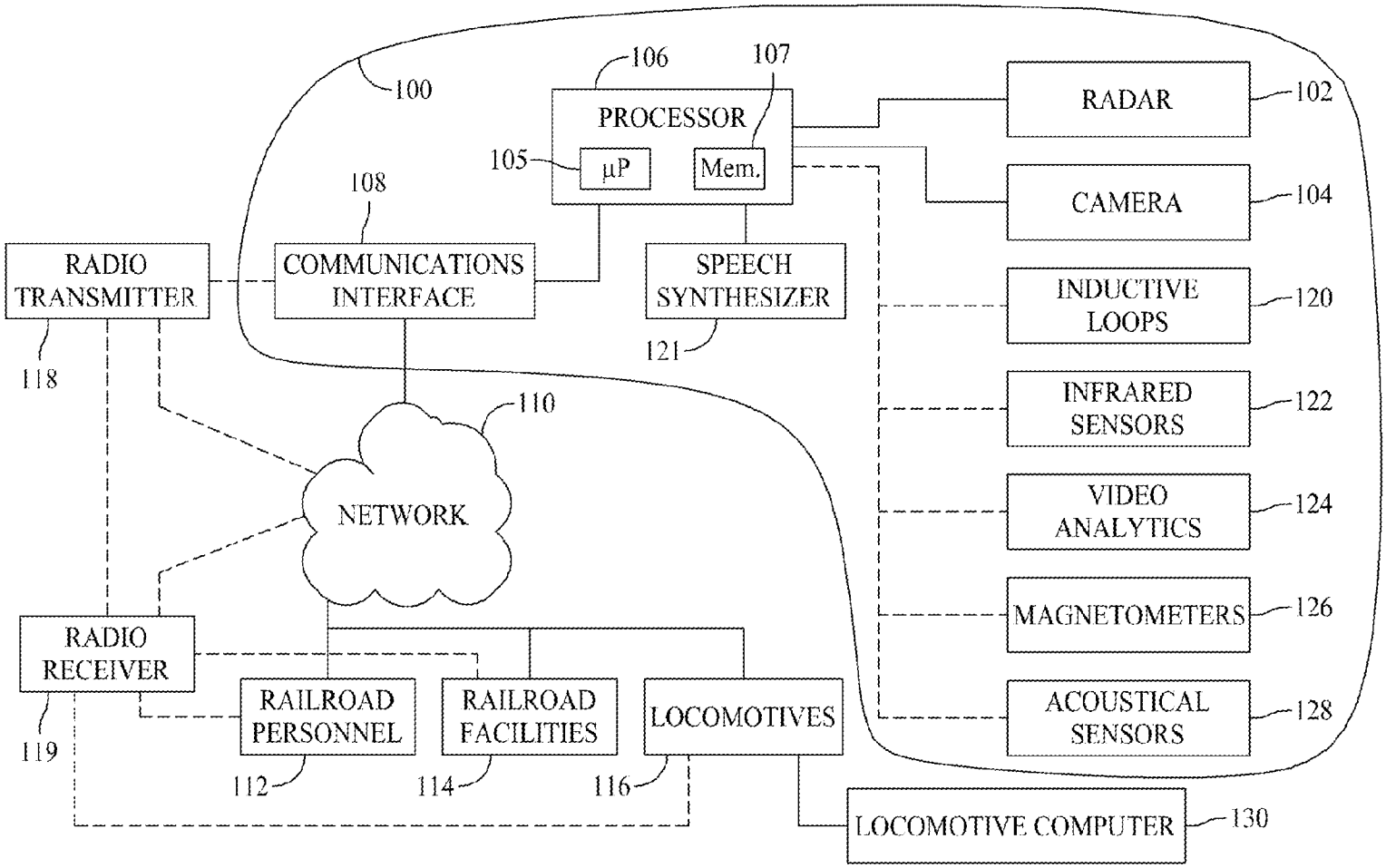
FIG. 1 is an exemplary block diagram of an embodiment of a blocked rail crossing detection and notification system.

FIG. 1 is a block diagram of an exemplary blocked rail crossing detection and notification system 100. As shown in FIG. 1, the exemplary system 100 includes at least one vehicle detection radar 102, at least one video camera 104 to capture images of potential obstruction situations, a local processor 106 programmed to receive data from radar 102 and camera 104 to identify potentially halted vehicles obstructing a railway, and a communications interface 108 operable in relation to one or more networks 110 over which notification messages and images may be sent to remotely located devices associated with, as shown in the example of FIG. 1, railroad personnel 112, railroad facilities 114, and/or en-route locomotives 116. In contemplated exemplary embodiments, the railroad personnel may include personnel in the vicinity of the rail grade crossing or in remote locations, railroad facilities may include a centralized dispatch center, and messages directed to en-route locomotives may be directed to devices onboard the locomotives to advise engineers responsible for locomotive(s) in the vicinity of the blocked crossing.

The term "processor", in relation to the local processor 106, may in various embodiments be, for example, a controller such as a microcomputer, a programmable logic controller, or other processor-based device. Accordingly, it may include a microprocessor 105 and a memory 107 for storing instructions, control algorithms and other information as required for the system 100 to function in the manner described. The memory 107 may be, for example, a random access memory (RAM), or other forms of memory used in conjunction with RAM memory, including but not limited to flash memory (FLASH), programmable read only memory (PROM), and electronically erasable programmable read only memory (EEPROM). Alternatively, non-processor based electronics and circuitry may be provided in the controller with equal effect to serve similar objectives. For example, a supercapacitor may be provided to give the controller time to store procedure sensitive data such as the current state in a software based state machine in the event of power loss.

The network 110 may be any of a variety of known communication networks, including but not limited to long and short range radio communication networks, cellular communication networks, telephone networks, satellite transmission networks, Internet transmission networks, and/or data transmission networks of all kinds. The network 110 may further be, in various exemplary embodiments, a hard wired, point-to-point communication network, a wireless network in which communications are made over air interfaces, or may include combinations of wired and wireless techniques.

For example only, the system 100 shown in FIG. 1 may include a radio transmitter 118 and a radio receiver 119 capable of communicating with one another (using either digital or analog radio techniques) in either a point-to-point or peer-to-peer protocol or in a network of radio transmitters and receivers. In further embodiments, combination transmitter and receiver devices, sometimes referred to as transceivers, may be utilized to establish bidirectional communication between the communications interface 108 located at the site of the railway crossing and remotely located personnel 112, railroad facilities 114, or locomotives 116. It is understood that multiple transmitters 118 and receivers 119 would be used for communication messages and notifications from various railway crossing at different geographic locations to personnel 112, facilities 114 and locomotives 116 also at various geographic locations.

The system 100 may also include, as shown in FIG. 1, a speech synthesizer 121 that may be used to automatically generate audio messages and blocked rail notification reports to remote locations via the interface 108 and the network 110. As further explained below, in certain embodiments image data is also transmitted through the network 110 to provide visual inspection of railway obstruction events from remote locations. Audio information, image information, and data information may be communicated through the network 110 using the same or different network paths to provide varying degrees of system redundancy and sophistication.

The vehicle detection radar 102 and the video camera 104 represent different detection technologies for identifying a blocked rail crossing, and the radar 102 and the video camera 104 may be used separately or in combination as desired. That is, in certain embodiments, the system 100 may be provided with one or the other, but not both of the radar 102 and the video camera 104. In other embodiments, the system 102 may include both the radar 102 and the video camera 104 for selective use by the system 100 as desired or as needed according to user preference or suitability for specific locations wherein the system 100 is installed. In still other embodiments, the radar 102 and the video camera 104 may be simultaneously used to provide different indications of a blocked rail crossing with a degree of redundancy. The system 100 is therefore readily adaptable and flexible to produce systems of varying sophistication and complexity.

The blocked rail crossing detection and notification system 100 may likewise incorporate a variety of alternative detection sensors that are communicatively coupled to processor 106 in addition to or in place of vehicle detection radar 102 and/or the video camera 104 as shown in FIG. 1. Such alternative detection sensors may likewise be used to monitor vehicles traveling over the crossing island, either used as stand alone detection elements or in combination with one another. Such alternative detection sensors may include, for example, buried inductive loops 120, infrared sensors 122, video analytics 124, magnetometers 126, and acoustical sensors 128. As further explained herein, exemplary embodiments of the system 100 may include at least a microwave radar sensor (radar 102) placed such that it will sense a presence of an obstruction such as a vehicle across the entire crossing island area, or an obstruction such as a vehicle that is located outside the island and MTCD zone but still in the path of an approaching train, with radar 102 mounted out of the roadway, for example, atop an entrance gate mast associated with the crossing. However, as noted above, contemplated embodiments of the system 100 are not limited to those that incorporate radar 102.

A multiplicity of vehicle detection technologies working collaboratively may be implemented in the system 100 to avoid possible false detection of obstructions and/or human error in responding to blocked crossing events. For example, in a system reliant on human operator(s) to visually determine or confirm blocked rail crossings via images acquired with the video camera 104, an inattentive or poorly trained operator may not promptly take appropriate action to notify others of a blocked crossing. A collaborative use of a multiplicity of vehicle detection technologies, however, may minimize, if not eliminate, any need for image data delivered to a human recipient. For instance, a radar detection system 102 in conjunction with an ending inductive loop-based detection system 120 can provide a sufficiently reliable indication of an obstructing vehicle presence in the crossing so as to automatically generate an alert message to railroad personnel, without any need for confirmation of the obstruction event by a person before the alert message is generated. That is, the collaborative use of vehicle detection technologies can be utilized to automatically detect and confirm blocked crossing events by comparing feedback signals from the various redundant, but different, detection technologies provided. Specifically, if less than all of the various detection technologies provided detects an obstruction, an error condition may be presumed which likely would correspond to a false detection of a railway obstruction. False detection events may accordingly be identified without assistance from human persons, and real time blocked rail crossing information and alerts may be generated much more quickly.

Further, a collaborative implementation of multiple and different vehicle detection technologies may facilitate transmission of reliable blocked crossing alerts across communication mediums either poorly suited for, if not capable of, transporting a visual image from a remote location. Examples of such networks include voice cellular radio, or bandwidth constricted networks.

Figure 2:
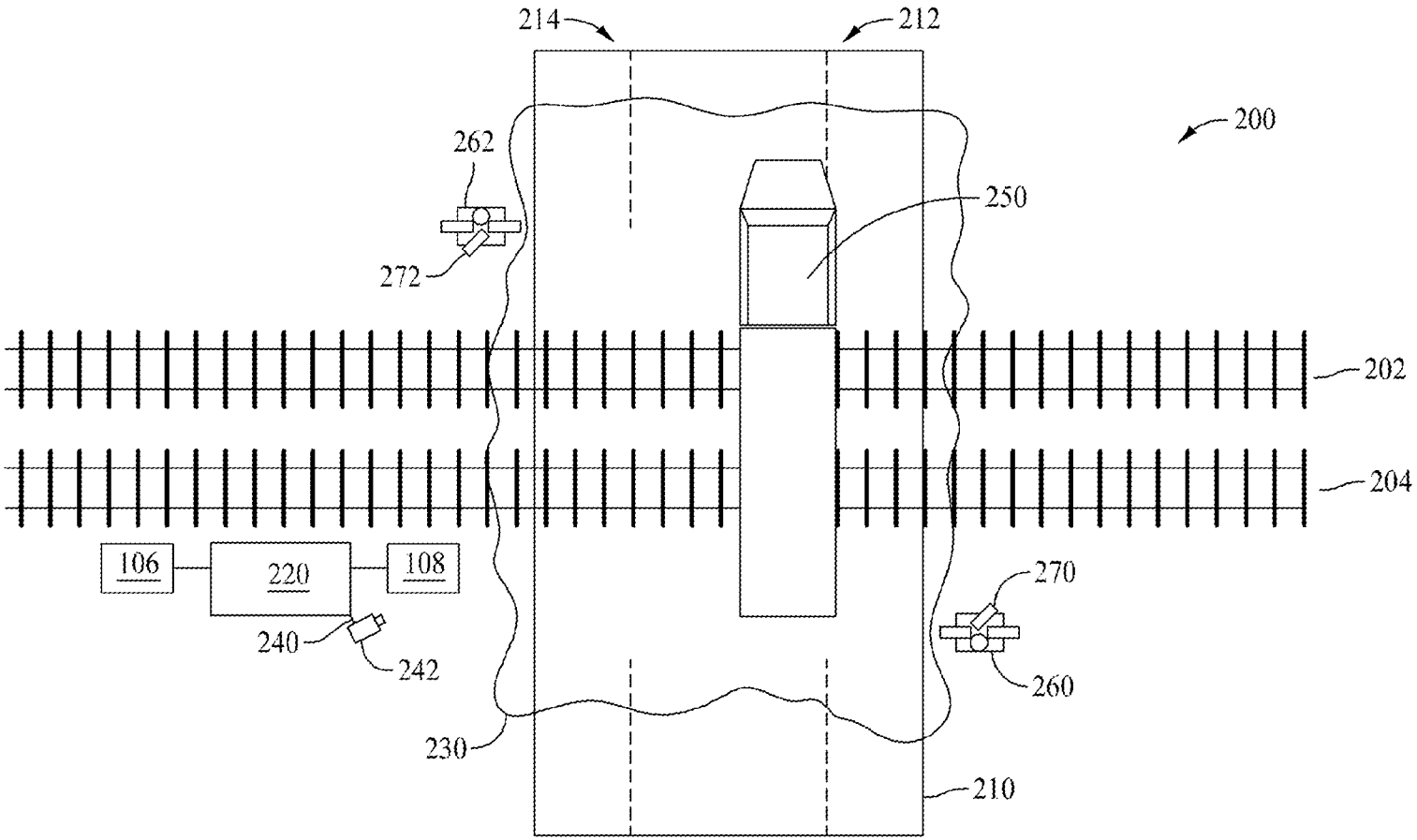
FIG. 2 is an exemplary top view of a grade crossing incorporating the exemplary embodiment of the blocked rail crossing detection and notification system shown in FIG. 1.

FIG. 2 is an exemplary top view of a grade crossing 200. As is the case with a typical grade crossing, grade crossing 200 includes at least one set of rail tracks 202, 204, the intersecting roadway 210 including lanes 212 and 214, and a crossing equipment bungalow 220. Tracks 202, 204, roadway 210 and bungalow 220 roughly define the crossing island 230. Certain sensor devices, including but not limited to those mentioned above, are connected to a bungalow mounted electronics assembly 240 that provides crossing occupancy information by lane. In the embodiment of FIG. 2, an outdoor video camera 242 (which may correspond to the camera 104 shown in FIG. 1 or be separately provided) with a view of the entire physical crossing area (island 230) provides image information that is included in notification data sent to railroad personnel 112 (FIG. 1) when a potential obstruction 250 is detected. Thus, railroad personnel 112 may not only be provided notification of an actual (or perhaps even potential) obstruction 250 inside or outside the island and MTCD zone, but may specifically see from the image the actual condition of the island 230 in real time.

In one exemplary embodiment, the camera 242 is equipped with a protective housing and heater where necessary, and is mounted on the equipment bungalow 220. In another embodiment, the camera 242 is mounted on a separate pole, or mounted at any other location from which an adequate view of the crossing area (island 230 and adjacent areas) may be obtained. Entrance gate masts 260, 262 are associated with the island 230. In the embodiment illustrated in FIG. 2, microwave radar sensors 270, 272 are placed such that in combination, they will sense across the entire area of the crossing island 230 (as well as the immediately adjacent area outside the boundary of the crossing island and the MTCD zone 230 within range of the radar sensors), with the radar sensors 270, 272 mounted out of the roadway 210. In certain embodiments, and in the embodiment of FIG. 2, a radar sensor 270, 272 is associated with each of the respective entrance gate masts 260, 262. Sensors 270, 272 may be mounted in other locations associated with a grade crossing, however. In an alternative embodiment, each radar sensor 270, 272 is configured for sensing the entirety of the crossing island 230, which may provide redundancy in the case of a radar failure.

The grade crossing 200 is further equipped to provide status and control signals available from a railroad crossing controller, to alert operators of road vehicles of an approaching locomotive. Island Relay and Crossing Relay signals, familiar to those in the art, may be supplied for such purposes. The system 100, and in particular the local processor 106, may further interface with these status and control signals for further detection reliability. For example, known Island Relay circuits will indicate when a train is occupying the crossing. During these periods when a train is present at the crossing, virtually all of the vehicle detection system technologies provided in the system 100 will also register a "detection" state and indicate a blocked crossing. An Island Relay signal, or other status and control signal provided for detection of the train can be coordinated and compared with the signals from the vehicle detection sensors provided to prevent a false, blocked crossing detection and related alerts when the blocked crossing detection is, in fact, attributable to the presence of the a train, rather than some other obstruction (e.g., a vehicle), in the island.

Components of the system 100 (FIG. 1) such as the processor 106 and communication interface 108 of the system 100, when deployed as shown in FIG. 2, may be deployed within bungalow 220. Specifically, electronics in the equipment bungalow may support the vehicle detection subsystem made up of radars 270, 272, and camera 242 (as well as the alternative sensor technologies as discussed above if provided), provides power to all such components, and operates a processor, such as processor 106, to detect potential obstruction situations within the crossing island and communicate such detections to, for example, a railroad dispatch center 114 (FIG. 1), railroad personnel 112 (FIG. 1), or locomotives 116 (FIG. 1) for the benefit of locomotive engineers.

When the system 100 is implemented in the crossing 200, an obstructing vehicle presence within each lane 212, 214 of roadway 210 is sensed and/or tracked. It is contemplated that roadways wider and narrower than the two lane embodiment of FIG. 2 may be included in any particular crossing. Additions of radar sensors or reconfiguration of radar sensors may ensure that all lanes of a roadway are accounted for. In one operative embodiment, any vehicle 250 that moves into the crossing island 230 and stops for a predefined, programmable period (e.g. 90 seconds or longer) is presumed to be disabled or permanently stranded in the crossing island 230. When such a vehicle 250 is detected by the sensors provided, the system 100 outputs data to the network 110 (FIG. 1). The output data may include, for example, pictures taken by the camera and/or displays generated from radar data (as well as data relating to any of the alternative sensors described above) for review by personnel associated with the railroad.

As those skilled in the art will readily understand, certain embodiments of the system 100 as contemplated utilize existing sensor technologies to identify that a vehicle is within a crossing island. One such technology incorporates video image capture and sophisticated classification analytics. However, environmental conditions and lighting situations degrade reliability and create finite uncertainty for a detection system based solely on video imaging as video image based solutions are somewhat subject to lighting and weather conditions. An additional sensor technology by which vehicles may be detected incorporates buried inductive loops. However, this detection solution has a shorter life and higher maintenance costs due to the embedding of the inductive loops within the ground. Specifically, inductive loops buried in the ground are subject to the wear and tear of the underground environment as well as the wear and tear incurred as highway and rail traffic pass over the loops. While very costly video/analytics and combinations of sensor technologies can achieve increasing levels of reliability, a level of uncertainty will always exist.

The embodiments described herein that utilize radar based detection provide a longer life and lower maintenance consequence solution as compared to embedded detection technology and do not require installation in the roadway itself. Further, non-embedded radar detection techniques are not weather and lighting dependent as are video image based solutions. In addition, the radar sensor based embodiments can be easily combined with the existing technologies described herein. Incorporation of the communications modalities described herein, both with and without radar based sensors, provide a more reliable mechanism for detecting candidate blocked crossing situations and forwarding such notifications to a person with far greater processing resources and situational awareness. With more reliable data, that person can make better decisions regarding whether and what kind of response should be taken, such as alerting locomotives approaching the crossing of the obstruction in order to lessen the chance of a collision. Combining the radar sensor and communications capabilities with existing technologies provides an increasingly reliable blocked rail crossing detection and notification system.

Figure 3:
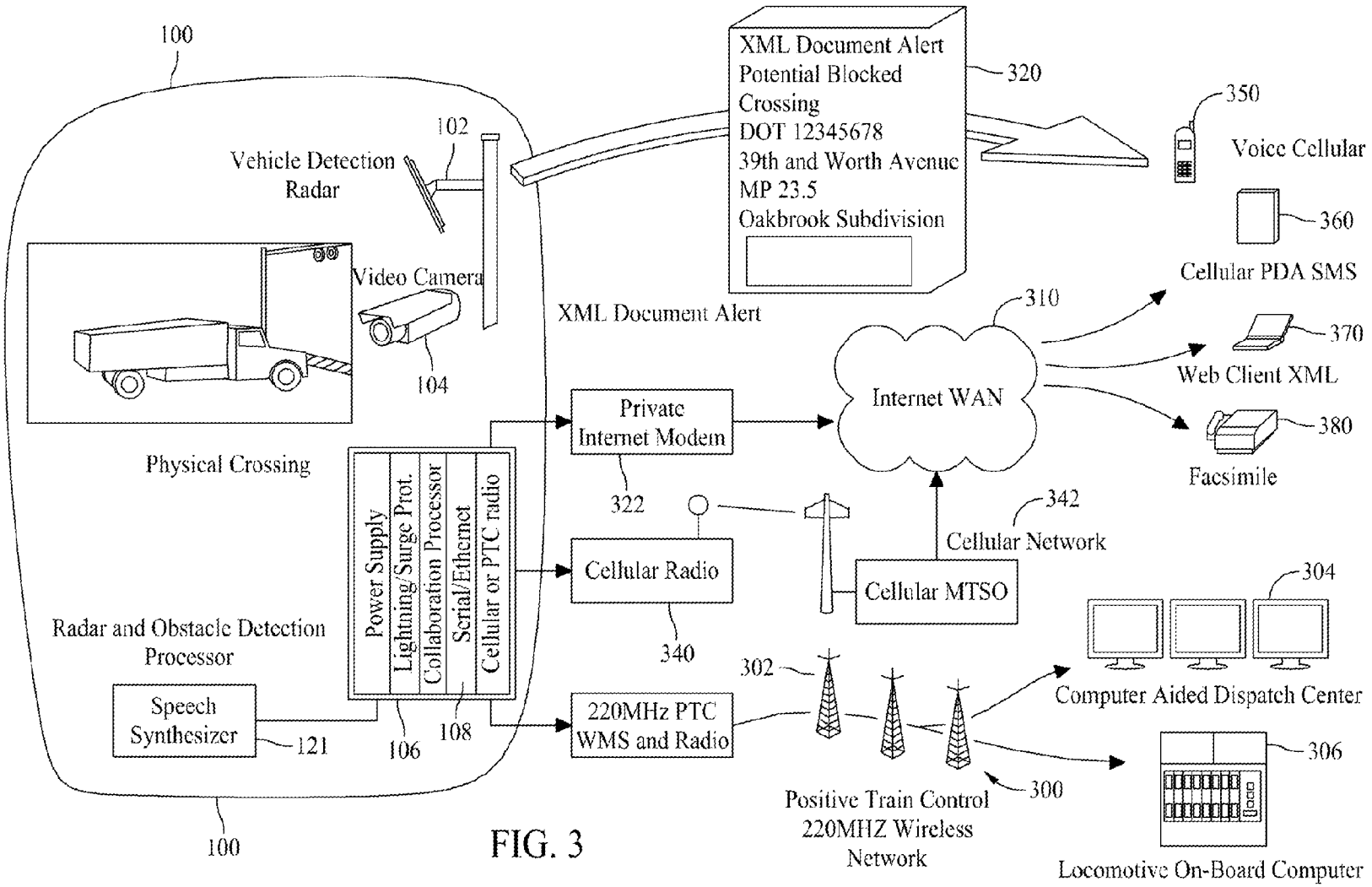
FIG. 3 is a schematic diagram illustrating exemplary communication modalities that may be interfaced with the blocked rail crossing detection and notification system shown in FIG. 1.

FIG. 3 is a schematic diagram of system 100 communicatively coupled to numerous wired and wireless communication network options, illustrating it is now possible to more efficiently detect a possible obstruction, or candidate, and send a notification to the network, along with an image of the crossing island and/or radar image data, to a human who can interpret the situation. FIG. 3 illustrates that the "network" includes one or multiple modalities for transfer of the information from system 100 to a human consumer of such information. Such human interpretation provides reliability as other dynamic and situational data can be taken into account.

One communications modality contemplated is the railroad industry's Positive Train Control (PTC) private wireless infrastructure 300. In the PTC infrastructure 300, the communications interface 108 associated with processor 106 is to a 220 MHz wireless network 302 (or other PTC communication modalities as may become available) that provides the crossing island sensor detection information, as described above, to one or both of a computer aided railroad dispatch center 304 or an onboard computer 306 associated with a particular locomotive. Of course, such information may be distributed to multiple locomotives, as determined by the particular crossing island situation and the current location of those locomotives relative to the crossing.

In addition to or separate from the PTC infrastructure 300, wired and wireless Internet 310 may be utilized for delivering notification data relating to a vehicle detection within the crossing island, for instance in the form of an XML document 320, to railroad resources using the public or private Internet. Wired Internet may be accomplished using nearby public network resources such as cable or DSL routed to the crossing bungalows 200 (FIG. 2) where a modem 322 is communicatively coupled to the communications interface 108 of processor 106. Wireless Internet may be utilized using available wireless channels such as a community Wi-Fi system.

Cellular radio 340 is yet another communications modality that can be communicatively coupled to the communications interface 108 of processor 106 and eventually routed to the Internet 310 for communications of data relating to vehicle detection within the crossing island. Examples include a digital cellular radio 340 over the public cellular network 342. Voice or text message notifications may accordingly be utilized over cellular devices.

The PTC infrastructure 300, wired and wireless Internet 310, and digital cellular radio 340 via the Internet 310, allow notification data to be formed and delivered in a variety of forms. One delivery form includes synthesized voice message alerts, generated by the speech synthesizer 121 (FIG. 1) to specific telephones or cellular phones 350. As one example, recipients of a voice message may access an Internet channel and navigate to a location where an image may be seen, permitting full analysis of the potential obstructed crossing situation and execution of a commensurate response.

Another delivery form includes text or SMS message delivery to mobile devices such as handheld personal digital assistant (PDA) devices 360 or cellular telephones 350, either providing an embedded picture or an Internet hyperlink where an image may be found, permitting full analysis of the potential obstructed crossing situation and execution of a commensurate response.

Another delivery form is through a web services session where alert and image data are communicated to a client via a computer 370 that is located at a railroad organization, a local public safety organization, or a proximate maintenance location. Yet another delivery form is to a facsimile machine 380 along with embedded image information.

As previously mentioned, another delivery form is through a voice radio circuit where alert information is communicated to a client via speech synthesizer 121 (FIG. 1) and a UHF or VHF radio transmitter 118 (FIG. 1). Alert information regarding a potentially blocked or obstructed railroad crossing may be thus communicated to railroad personnel over the railroad organization's handheld or vehicle borne mobile radio system that may include the receiver 119 (FIG. 1).

With regard to the PTC infrastructure 300, the North American railroad industry has a private wireless networking infrastructure used for managing train traffic, under the Positive Train Control (PTC) legislation established in 2008. While the primary purpose of the PTC infrastructure is to control the speed and location of train traffic and to monitor the position of turnout switches, the PTC infrastructure is expected to be available for other railroad information management purposes. Primarily operating on (but not limited to) a ubiquitous 220 MHz wireless network as shown in FIG. 3, information from crossings and other wayside equipment may be made accessible over these private networks. With intrinsic connectivity to centralized Computer Aided Dispatch centers (CAD) and to on board locomotive computers, the PTC wireless infrastructure 300 is an ideal path across which potential crossing obstacle alerts may be delivered for review and possible action.

Future uses of the PTC network and the communication path between the locomotive and approaching crossings anticipate the on-board locomotive system communicating crossing warning system activation instructions in lieu of crossing-based track circuits currently used to detect approaching locomotives. Within the currently anticipated communications protocol between the crossing equipment and the onboard system are messages associated with the health and operational status of the crossing warning system, as well as verification of crossing warning system activation. It is anticipated that the verification of a clear and unobstructed crossing island will also be a valuable status message as the approaching locomotive onboard computer system activates the crossing and receives verification and acknowledgement of crossing warning system performance. Any failure of crossing warning system activation or a blocked crossing condition would cause the locomotive to reduce speed as necessary to prevent possible collisions, whether due to an inoperable gate system or an obstructed crossing island.

An onboard locomotive cab computer 130 can poll the system 100 at each crossing 200 utilizing the wireless PTC communication infrastructure. In this manner, a locomotive on approach to any given crossing may be appraised of crossing warning system status including whether or not the crossing island is clear of obstacles.

Numerous standardized document protocols exist for conveying an alert accompanied by an image to any of the aforementioned recipient devices or utilizing any of the aforementioned wide area networks. As mentioned herein, the most common is an XML document, a self-describing information wrapper that is typically used for IP networks and interprocess communication. XML documents are readily utilized, or consumed, by recipient devices for presentation, without requiring the sender application to have a prior awareness of the capabilities of the possible recipient, consumer devices. Other alert formats include publish/subscribe and other proprietary UDP protocols. As mentioned in the foregoing, communication over the PTC network utilizes messages and protocols established by and standardized upon the entire railroad industry to assure interoperability across all railroad operators and territories.

Figure 4:
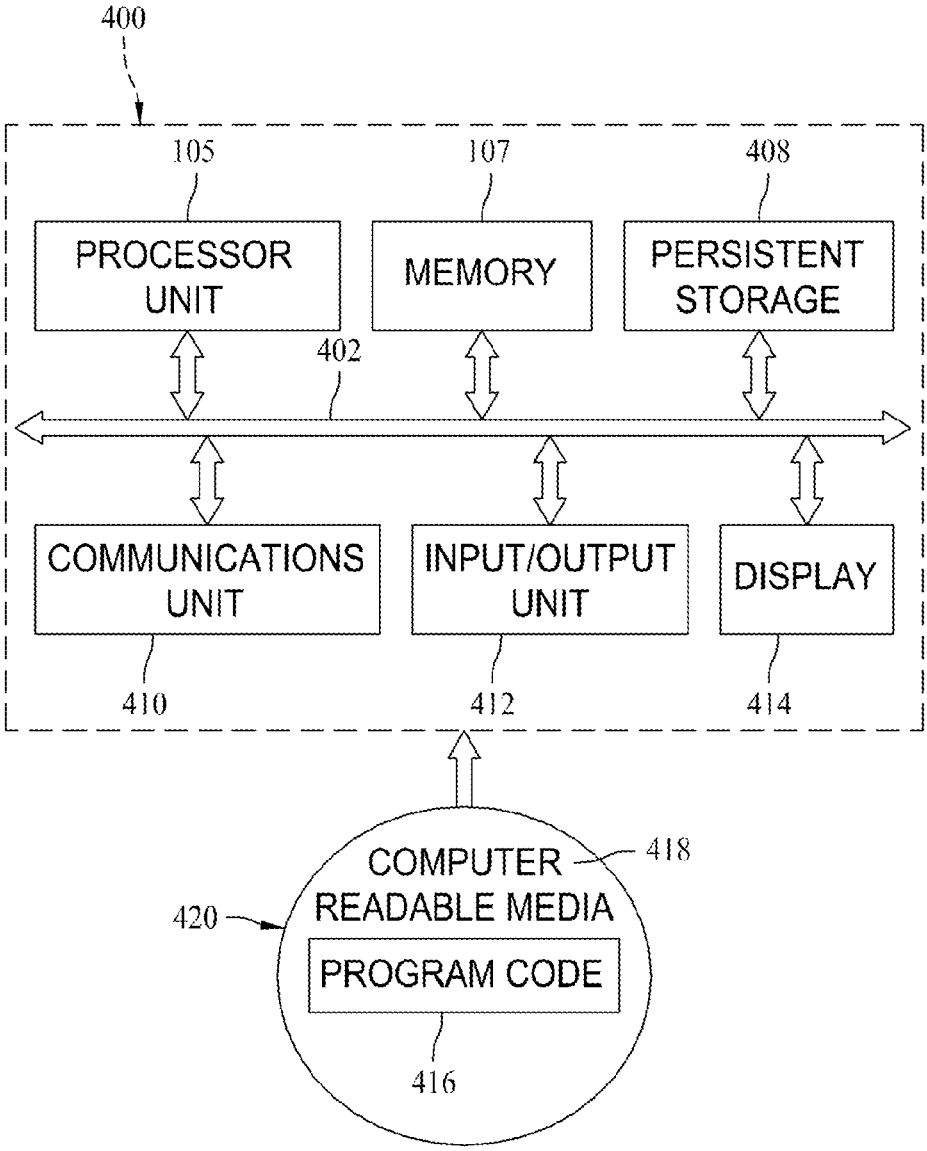
FIG. 4 illustrates an exemplary diagram of a data processing system embodiment that may be utilized with the processing function associated with the blocked rail crossing detection and notification system shown in FIG. 1.

Turning now to FIG. 4, one embodiment of a data processing system such as may be incorporated with processor 106 is depicted in accordance with an illustrative embodiment. In this illustrative example, data processing system 400 includes a communications fabric 402, which provides communications between processing unit 105, memory 107, persistent storage 408, communications unit 410, input/output (I/O) unit 412, and a display 414.

Processor unit 105 serves to execute instructions for software that may be loaded into memory 107. Processor unit 105 may be a set of one or more processors or may be a multiprocessor core, depending on the particular implementation. Further, processor unit 105 may be implemented using one or more heterogeneous processor systems in which a main processor is present with secondary processors on a single chip. As another illustrative example, processor unit 105 may be a symmetric multi-processor system containing multiple processors of the same type.

Memory 107 and persistent storage 408 are examples of storage devices. A storage device is any piece of hardware that is capable of storing information either on a temporary basis and/or a permanent basis. Memory 107, in these examples, may be, for example, without limitation, a random access memory or any other suitable volatile or non-volatile storage device. Persistent storage 408 may take various forms depending on the particular implementation. For example, without limitation, persistent storage 408 may contain one or more components or devices. For example, persistent storage 408 may be a hard drive, a flash memory, a rewritable optical disk, a rewritable magnetic tape, or some combination of the above. The media used by persistent storage 408 also may be removable. For example, without limitation, a removable hard drive may be used for persistent storage 408.

Communications unit 410, in these examples, provides for communications with other data processing systems or devices and is equivalent to communications interface 108 described above. Communications unit 410 may provide communications through the use of either or both physical and wireless communication links as described above.

Input/output unit 412 allows for input and output of data with other devices that may be connected to data processing system 400. For example, without limitation, input/output unit 412 may provide a connection for user input through a keyboard and mouse. Further, input/output unit 412 may send output to a printer. Display 414 provides a mechanism to display information to a user.

In one embodiment, instructions for the operating system and applications or programs are located on persistent storage 408. These instructions may be loaded into memory 107 for execution by processor unit 105. The processes of the different embodiments may be performed by processor unit 105 using computer implemented instructions, which may be located in a memory, such as memory 107. These instructions are referred to as program code, computer usable program code, or computer readable program code that may be read and executed by a processor in processor unit 105. The program code in the different embodiments may be embodied on different physical or tangible computer readable media, such as memory 107 or persistent storage 408.

Program code 416 is located in a functional form on computer readable media 418 that is selectively removable and may be loaded onto or transferred to data processing system 400 for execution by processor unit 105. Program code 416 and computer readable media 418 form computer program product 420 in these examples. In one example, computer readable media 418 may be in a tangible form, such as, for example, an optical or magnetic disc that is inserted or placed into a drive or other device that is part of persistent storage 408 for transfer onto a storage device, such as a hard drive that is part of persistent storage 408. In a tangible form, computer readable media 418 also may take the form of a persistent storage, such as a hard drive, a thumb drive, or a flash memory that is connected to data processing system 400. The tangible form of computer readable media 418 is also referred to as computer recordable storage media. In some instances, computer readable media 418 may not be removable.

Alternatively, program code 416 may be transferred to data processing system 400 from computer readable media 418 through a communications link to communications unit 410 and/or through a connection to input/output unit 412. The communications link and/or the connection may be physical or wireless in the illustrative examples. The computer readable media also may take the form of non-tangible media, such as communications links or wireless transmissions containing the program code.

In some illustrative embodiments, program code 416 may be downloaded over a network to persistent storage 408 from another device or data processing system for use within data processing system 400. For instance, program code stored in a computer readable storage medium in a server data processing system may be downloaded over a network from the server to data processing system 400. The data processing system providing program code 416 may be a server computer, a client computer, or some other device capable of storing and transmitting program code 416.

The different components illustrated for data processing system 400 are not meant to provide architectural limitations to the manner in which different embodiments may be implemented. The different illustrative embodiments may be implemented in a data processing system including components in addition to or in place of those illustrated for data processing system 400. Other components shown in FIG. 4 can be varied from the illustrative examples shown.

As one example, a storage device in data processing system 400 is any hardware apparatus that may store data. Memory 107, persistent storage 408 and computer readable media 418 are examples of storage devices in a tangible form.

In another example, a bus system may be used to implement communications fabric 402 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, without limitation, memory 107 or a cache such as that found in an interface and memory controller hub that may be present in communications fabric 402.

As explained above in relation to FIGS. 1-4, the above described blocked rail crossing detection and notification system 100 is operable for providing an automated detection of vehicles that are stored, disabled, or deliberately placed within a crossing island and an automated providing of event and/or image data regarding blocked railroad crossing situations to railroad personnel or public safety officials for verification. The event and image data is provided to a user via one or more of cellular telephones, voice telephones, PDAs, on-line computers, and facsimile to name a few. The event and image data related to possible blocked railroad crossing conditions to centralized railroad dispatch centers is communicated to the above listed devices over one or more of a positive train control network, a cellular communications channel, and/or a private or public Internet connection.

Detailed data collection, archiving and reporting functionality is further provided to facilitate traffic analysis at crossing islands of interest, to analyze false detection events and troubleshoot the system, and for other informational purposes as desired.

The advantages of the inventive concepts described are now believed to have been amply demonstrated in the exemplary embodiments disclosed.

An embodiment of a blocked rail crossing detection and notification system has been disclosed. The system comprises: a processing device; a communications interface communicatively coupled to said processing device and operable for facilitating communications between said processing device and at least one external device; and at least one vehicle detection mechanism placed proximate to a rail grade crossing, said at least one vehicle detection mechanism communicatively coupled to said processing device and operable to provide signals to said processing device indicative of the presence or non-presence of a vehicle within a defined area surrounding an intersection of a roadway and one or more railroad tracks, said processing device programmed to communicate the presence or non-presence of a vehicle within the defined area to the at least one external device.

Optionally, the at least one vehicle detection mechanism may include at least one radar sensor placed proximate to the rail grade crossing. The communications interface may be operable for providing a communication regarding the presence of a vehicle within the defined area as sensed by said at least one radar sensor over at least one of the North American Railroad Positive Train Control network and a cellular telephone network. The at least one vehicle detection mechanism may also include at least one video camera placed proximate to the rail grade crossing, and the communications interface may be operable for providing a communication regarding the presence of a vehicle within the defined area as image data acquired by said at least one video camera over at least one of the North American Railroad Positive Train Control network and a cellular telephone network.

Also optionally, the at least one vehicle detection mechanism includes multiple and different vehicle detection mechanisms. The multiple and different vehicle detection mechanisms may be collaboratively coordinated by the processing device to automatically detect and confirm a blocked crossing event. The processing device may be configured to, based on signals from the multiple and different vehicle detection mechanisms, identify a false blocked crossing detection event.

The crossing may optionally include at least one status and control signal for warning roadway vehicles of an impending train, and the processing device may be configured to monitor the status and control signal to avoid a false blocked crossing detection event. The system may further include a speech synthesizer, with the processing device configured to communicate an audio message from the speech synthesizer. The processing device may be programmed to communicate the presence or non-presence of a vehicle within the defined area via one of a fax communication, a voice message, a data message, and a text message.

Another embodiment of a system for monitoring a rail crossing for an obstruction and notifying railroad personnel of the same has been disclosed. The system comprises: a processor-based device located proximate the rail crossing; a communications interface communicatively coupled to said processing device and operable for facilitating communications between said processor based device and a location remote from the rail crossing; and a plurality of obstruction sensors monitoring the rail grade crossing, each of said plurality of obstruction sensors being communicatively coupled to said processor-based device and operable to provide respective signals to said processing device indicative of the presence of an obstruction in the path of one or more railroad tracks at the crossing, said processor based device programmed to communicate the presence of the obstruction to the location remote from the railroad crossing.

Optionally, the plurality of obstruction sensors may include at least one sensor embedded in the crossing. The plurality of obstruction sensors may also include at least one radar sensor. The plurality of obstruction sensors may include multiple sensors each respectively configured to detect the obstruction in a different manner. The multiple and different vehicle detection sensors may be collaboratively coordinated by the processing device to automatically detect and confirm a blocked crossing event. The processing device may be configured to, based on signals from the multiple and different vehicle detection sensors, identify a false blocked crossing detection event. The crossing may include at least one status and control signal for warning roadway vehicles of an impending train, and the processing device may be configured to monitor the status and control signal to avoid a false blocked crossing detection event. The communications interface may be operable for facilitating communications between said processing device and a location remote from the rail crossing via a communications network, with the network including one of wired and wireless communication paths.

An embodiment of a system for monitoring a rail crossing intersecting a roadway for an obstruction in the path of an approaching locomotive and for notifying railroad personnel of the same has also been disclosed. The system comprises: a processor-based device local to the rail crossing; a communications interface communicatively coupled to said processing device and operable for facilitating communications between said processor based device and a remote location; and a plurality of obstruction sensors each monitoring the rail grade crossing for an obstruction in a different manner, each of said plurality of obstruction sensors being communicatively coupled to said processor-based device and operable to provide respective signals to said processing device indicative of the presence of an obstruction in the path of one or more railroad tracks at or proximate the crossing. The processor based device is configured to: compare the signals from the plurality of obstruction sensors to determine whether an obstruction exists; and if the obstruction is determined to exist, communicate the presence of the obstruction to the location remote from the railroad crossing.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of identifying a blocked rail crossing, the method implemented with a blocked crossing detection and notification system including a processing device, a communications interface communicatively coupled to said processing device and operable for facilitating communications between said processing device and at least one external device, and at least one detection mechanism placed proximate to a rail grade crossing, said at least one detection mechanism communicatively coupled to said processing device, said method comprising:

continuously operating the at least one detection mechanism with the processing device;

automatically assessing, based on continuous operation of the at least one detection mechanism with the processing device, a real time presence or absence of a blockage within a defined area surrounding an intersection of a roadway and one or more railroad tracks; and continuously delivering, with the processing device, information regarding the assessed real time presence or absence of a blockage to the at least one external device at a location remote from the defined area, whereby a railroad organization receiving the assessed presence or absence of the potential blockage at the location remote from the defined area may analyze an assessed blockage in real time and execute a commensurate response.

2. The method of claim 1, wherein continuously delivering information regarding the assessed real time presence or absence of a blockage to the at least one external device comprises:

communicating a real time presence of a blockage within the defined area whenever the blockage is assessed; and communicating a real time absence of a blockage within the defined area whenever the absence of a blockage is assessed.

3. The method of claim 1, wherein continuously delivering information regarding the assessed real time presence or absence of a blockage to the at least one external device comprises communicating data relating to one of the assessed presence or the assessed absence of a potential blockage to a railroad dispatch center.

4. The method of claim 1, wherein continuously delivering information regarding the assessed real time presence or absence of a blockage to the at least one external device comprises communicating data relating to the assessed presence or absence of a potential blockage to a locomotive approaching the defined area.

5. The method of claim 1, wherein continuously delivering information regarding the assessed real time presence or absence of a blockage to the at least one external device comprises communicating data relating to the assessed presence or absence of a potential blockage to railroad personnel.

6. The method of claim 1, wherein the at least one detection mechanism includes multiple and different detection mechanisms operating in a different manner, and the method further comprises:

continuously operating the multiple and different detection mechanisms with the processing device;

individually assessing, with the processing device, a presence or absence of a potential blockage within the defined area surrounding an intersection of a roadway and one or more railroad tracks based on operation of each of the multiple and different detection mechanisms; and determining, with the processing device, a false blocked crossing event based on the individual assessments of the presence or absence of the potential blockage.

7. The method of claim 1, wherein continuously delivering information regarding the assessed real time presence or absence of a blockage to the at least one external device comprises delivering the information over a communication network.

8. The method of claim 7, wherein delivering the information over the communication network comprises delivering the information over one of a long range or short range radio communication network.

9. The method of claim 7, wherein delivering the information over the communication network comprises delivering the information over one of a cellular communication network, a telephone network, a satellite transmission network, an Internet transmission network, or a data transmission network.

10. The method of claim 7, wherein delivering the information over a communication network comprises generating at least one of a synthesized voice message alert, a text message to a mobile device, a web services session, a radio message, or a facsimile.

11. The method of claim 7, wherein delivering the information over the communication network comprises wirelessly transmitting the information.

12. The method of claim 7, wherein wirelessly transmitting the information comprises communicating the information over a Positive Train Control (PCT) infrastructure.

13. The method of claim 7, wherein delivering the information over the communication network comprises delivering at least one of an alert, an image, or a video relating to a candidate obstruction.

14. The method of claim 1, further comprising:

generating an alert to a locomotive approaching the defined area to reduce speed to avoid a possible collision when a real time presence of a blockage is automatically assessed.

15. The method of claim 1, wherein automatically assessing, based on continuous operation of the at least one detection mechanism, a real time presence or absence of a potential blockage within the defined area comprises automatically assessing a real time presence or absence of a vehicle within the defined area.

16. The method of claim 1, wherein continuously operating the at least one detection mechanism comprises continuously operating at least one radar detection system.

17. The method of claim 1, wherein the rail grade crossing includes at least one status and control signal for warning roadway vehicles of an impending train, and the method comprising monitoring the status and control signal to avoid a false blocked crossing detection event.

18. A method of identifying a blocked rail crossing, the method implemented with a blocked crossing detection and notification system including a processing device, a communications interface operable for facilitating communications between said processing device and at least one external device, and at least one detection mechanism placed proximate to a rail grade crossing, wherein the at least one detection mechanism is communicatively coupled to the processing device, the blocked crossing detection and notification system configured to continuously operate the at least one detection mechanism with the processing device and automatically assess, based on continuous operation of the at least one detection mechanism, a real time presence or absence of a blockage within a defined area surrounding an intersection of a roadway and one or more railroad tracks;

said method comprising:

delivering information, with the processing device and a communications network, regarding the automatically assessed real time presence or absence of a blockage to the at least one external device at a location remote from the defined area, whereby a railroad organization receiving the assessed presence or absence of the potential blockage at the location remote from the defined area may analyze an assessed blockage in real time and execute a commensurate response.

19. The method of claim 18, wherein delivering information comprises generating an alert to a locomotive approaching the crossing to reduce speed to avoid a possible collision.

20. A method of identifying a blocked rail crossing, the method implemented with a blocked crossing detection and notification system including a processing device, a communications interface operable for facilitating communications between said processing device and at least one external device, and at least one vehicle detection mechanism placed proximate to a rail grade crossing, wherein the at least one vehicle detection mechanism is communicatively coupled to the processing device, the blocked crossing detection and notification system configured to continuously operate the at least one detection mechanism with the processing device;

said method comprising:

automatically assessing, based on continuous operation of the blocked crossing detection and notification system, a real time presence or absence of a blockage within a defined area surrounding an intersection of a roadway and one or more railroad tracks.

21. The method of claim 20 further comprising delivering information, with the processing device and a communications network, regarding the automatically assessed real time presence or absence of a blockage to the at least one external device at a location remote from the defined area, whereby a railroad organization receiving the assessed presence or absence of the potential blockage at the location remote from the defined area may analyze an assessed blockage in real time and execute a commensurate response.

* * * * *